US009322602B2

(12) United States Patent
Lee et al.

(10) Patent No.: US 9,322,602 B2
(45) Date of Patent: Apr. 26, 2016

(54) HEAT EXCHANGER HAVING A PLURALITY OF PLATE-LIKE FINS AND A PLURALITY OF FLAT-SHAPED HEAT TRANSFER PIPES ORTHOGONAL TO THE PLATE-LIKE FINS

(71) Applicant: MITSUBISHI ELECTRIC CORPORATION, Chiyoda-ku (JP)

(72) Inventors: Sangmu Lee, Tokyo (JP); Akira Ishibashi, Tokyo (JP); Takuya Matsuda, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/515,994

(22) Filed: Oct. 16, 2014

(65) Prior Publication Data

US 2015/0033789 A1 Feb. 5, 2015

Related U.S. Application Data

(62) Division of application No. 12/994,193, filed as application No. PCT/JP2009/058685 on May 8, 2009, now abandoned.

(51) Int. Cl.
*F28F 1/00* (2006.01)
*F28F 1/42* (2006.01)
(Continued)

(52) U.S. Cl.
CPC . *F28F 1/12* (2013.01); *B21D 53/08* (2013.01); *F25B 1/005* (2013.01); *F28D 1/0478* (2013.01);
(Continued)

(58) Field of Classification Search
CPC ..... F28F 1/12; F28F 1/40; F28F 1/325; F28F 1/022; F28F 1/405; F28F 1/10
USPC ..... 165/172, 177, 179, 181–182, 183
See application file for complete search history.

(56) References Cited

U.S. PATENT DOCUMENTS 3,142,970 A 8/1964 Hale
3,486,489 A 12/1969 Huggins
(Continued)

FOREIGN PATENT DOCUMENTS

DE 3302150 A1 7/1984
DE 9315296 U1 3/1994
(Continued)

OTHER PUBLICATIONS

International Search Report (PCT/ISA/210) issued on Jun. 23, 2009, by Japanese Patent Office as the International Searching Authority for International Application No. PCT/JP2009/058685.
(Continued)

*Primary Examiner* — Frantz Jules
*Assistant Examiner* — Steve Tanenbaum
(74) *Attorney, Agent, or Firm* — Buchanan Ingersoll & Rooney PC

(57) ABSTRACT

A heat exchanger provided with a plurality of plate-like fins 2 arranged in parallel with a predetermined interval and a plurality of flat-shaped heat transfer pipes 3 inserted in a direction orthogonal to said plate-like fins 2 and through which a refrigerant flows, in which said heat transfer pipe 3 has an outside shape with a flat outer face arranged along an air flow direction and a section substantially in an oval shape and first and second refrigerant flow passages 31*a*, 31*b* made of two symmetric and substantially D-shaped through holes having a bulkhead 32 between the two passages inside, which is bonded to said plate-like fin 2 by expanding diameters of said first and second refrigerant flow passages 31*a*, 31*b* by a pipe-expanding burette ball.

4 Claims, 8 Drawing Sheets

(51) Int. Cl.

| | |
|---|---|
| ***F28F 1/20*** | (2006.01) |
| ***F28F 1/30*** | (2006.01) |
| ***F28F 1/14*** | (2006.01) |
| ***F28F 1/12*** | (2006.01) |
| ***F28D 1/047*** | (2006.01) |
| ***F28F 1/02*** | (2006.01) |
| ***F28F 1/32*** | (2006.01) |
| ***B21D 53/08*** | (2006.01) |
| ***F25B 1/00*** | (2006.01) |
| *F28F 1/40* | (2006.01) |
| *F28F 1/10* | (2006.01) |

(52) U.S. Cl.

CPC ..... *F28F 1/022* (2013.01); *F28F 1/325* (2013.01); *F28F 1/40* (2013.01); *F28F 1/10* (2013.01); *F28F 1/405* (2013.01); *F28F 2275/125* (2013.01); *Y10T 29/49373* (2015.01)

(56) References Cited

U.S. PATENT DOCUMENTS

| | | | | |
|---|---|---|---|---|
| 4,313,327 | A * | 2/1982 | O'Connor | B21C 23/085 425/132 |
| 4,738,311 | A * | 4/1988 | Bleckman | F28D 9/0062 165/165 |
| 5,381,600 | A | 1/1995 | Patel | |
| 5,542,271 | A | 8/1996 | Kudoh et al. | |
| 5,604,982 | A | 2/1997 | Kent et al. | |
| 5,699,675 | A | 12/1997 | Nagai et al. | |
| 6,349,761 | B1 | 2/2002 | Liu et al. | |
| 6,719,953 | B2 * | 4/2004 | Di Nicolantonio | B01J 8/062 165/177 |
| 6,928,833 | B2 * | 8/2005 | Watanabe | B21D 53/085 165/151 |
| 7,073,570 | B2 * | 7/2006 | Yu | F28D 1/0443 165/140 |
| 2003/0209344 | A1 | 11/2003 | Fang et al. | |
| 2004/0251016 | A1 | 12/2004 | Oh et al. | |
| 2005/0061494 | A1 | 3/2005 | Tsuji et al. | |
| 2006/0048928 | A1 * | 3/2006 | Maezawa | F25B 39/00 165/173 |
| 2007/0227712 | A1 | 10/2007 | Bugler, III et al. | |

FOREIGN PATENT DOCUMENTS

| | | | |
|---|---|---|---|
| EP | 0 709 641 | A2 | 5/1996 |
| EP | 0709641 | A2 | 5/1996 |
| JP | 61-161389 | A | 7/1986 |
| JP | 61-268985 | A | 11/1986 |
| JP | 64-31368 | U | 2/1989 |
| JP | 64-31369 | U | 2/1989 |
| JP | 4-41985 | U | 4/1992 |
| JP | 07-127985 | A | 5/1995 |
| JP | 8-086583 | A | 4/1996 |
| JP | 10-185474 | A | 7/1998 |
| JP | 11-094481 | A | 4/1999 |
| JP | 2000-018867 | A | 1/2000 |
| JP | 2000-356408 | A | 12/2000 |
| JP | 2003-148889 | A | 5/2003 |
| JP | 2003-262485 | A | 9/2003 |
| JP | 2005-164221 | A | 6/2005 |
| JP | 2005-265263 | A | 9/2005 |
| JP | 2006-162155 | A | 6/2006 |
| JP | 2008-064427 | A | 3/2008 |

OTHER PUBLICATIONS

Office Action from Japanese Patent Office issued in corresponding Japanese Patent Application No. 2008-160060 dated Jan. 11, 2011, with an English translation thereof.

Office Action (Notification of Reasons for Refusal) dated Apr. 12, 2011, issued in the corresponding Japanese Patent Application No. 2008-160060, and an English Translation thereof.

Office Action dated Apr. 13, 2012, issued in corresponding Chinese Patent Application No. 200980122967.4, and an English Translation thereon. (9 pages).

Office Action dated Sep. 13, 2012, issued by the Chinese Patent Office in the corresponding Chinese Patent Application No. 200980122967.4 and an English translation thereof. (8 pages).

Office Action (Text Portion of the Notification of the Third Office Action) issued Mar. 8, 2013, issued by the Chinese Patent Office in the corresponding Chinese Patent Application No. 200980122967.4 and an English translation thereof. (4 pages).

Extended European Search Report issued by European Patent Office on Feb. 28, 2014 in European Application No. 09766495.7 (9 PGS).

* cited by examiner

Prior Art

HEAT EXCHANGER HAVING A PLURALITY OF PLATE-LIKE FINS AND A PLURALITY OF FLAT-SHAPED HEAT TRANSFER PIPES ORTHOGONAL TO THE PLATE-LIKE FINS

TECHNICAL FIELD

The present invention relates to a heat exchanger and an air conditioner provided with this heat exchanger.

BACKGROUND ART

A prior-art heat exchanger constituting an air conditioner includes a heat exchanger called fin-tube heat exchanger. This heat exchanger is constituted by plate-like fins arranged with a certain interval and through which gas (air) flows and a flat-shaped heat transfer pipe inserted orthogonally into the plate-like fins and through which a refrigerant flows, and a plurality of protruding strips are provided in the axial direction on an inner face of the heat transfer pipe (See Patent Document 1, for example). Also, a heat exchanger having a flat-shaped heat transfer pipe in a multi-hole structure or a heat exchanger having a plurality of slits provided in a plate-like fin by cutting are included. The slit group is provided so that a side end portion of the slit opposes a flow direction of air, and it is described that by thinning a speed boundary layer and a temperature boundary layer of the air flow at the side end portion of the slit, heat transfer is promoted and heat exchange capacity is increased (See Patent Document 2, for example).

PRIOR ARTS

[Patent Document 1] Japanese Unexamined Patent Application Publication No. 11-94481 (FIGS. 1 to 3)

[Patent Document 2] Japanese Unexamined Patent Application Publication No. 2003-262485 (FIGS. 1 to 4)

SUMMARY OF INVENTION

Problems to be Solved by the Invention

In the heat exchanger of Patent Document 1, since the heat transfer pipe is formed in a flat elliptic shape having a single through hole through which a refrigerant flows, the heat transfer pipe is expanded and deformed by a pressure inside the heat transfer pipe during an operation of a refrigerating system, there is a problem that close contact between the heat transfer pipe and the plate-like fin is deteriorated.

With the purpose of improving performance of the heat exchanger, the heat transfer pipe can be made into a multi-hole structure and its size and diameter can be reduced as in Patent Document 2. However, by reducing the size and diameter of the heat transfer pipe, heat transfer rate in the pipe is increased while pressure loss is increased, and they need to be optimized. Also, the heat transfer pipe whose size and diameter are reduced is advantageous in heat transfer performance, but there is a problem that a cost for assembling or the like is increased since manufacture of the heat transfer pipe and mounting between the heat transfer pipe and the plate-like fin are carried out by brazing.

The present invention was made in order to solve the above problems and has an object to provide a heat exchanger and an air conditioner provided with this heat exchanger in which ventilation resistance is reduced and heat exchange capacity is increased by using a heat transfer pipe in which deformation of the heat transfer pipe caused by a pressure inside the heat transfer pipe does not occur even if the heat transfer pipe is made flat, close contact with the plate-like fin is favorable, assembling performance is good, and heat transfer performance is excellent.

Means for Solving the Problems

A heat exchanger according to the present invention is provided with a plurality of plate-like fins arranged in parallel with a predetermined interval and a plurality of flat-shaped heat transfer pipes inserted in a direction orthogonal to the plate-like fins and through which a refrigerant flows, and the heat transfer pipe has an outside shape with a flat outer face arranged along an air flow direction and a section substantially in an oval shape and first and second refrigerant flow passages made of two symmetric and substantially D-shaped through holes having a bulkhead between the two passages inside, which is bonded to the plate-like fin by expanding diameters of the first and second refrigerant flow passages by a pipe-expanding burette ball.

Advantages

According to the present invention, since the bulkhead partitioning the two refrigerant flow passages are provided inside the flat-shaped heat transfer pipe, deformation of the heat transfer pipe is not caused by a pressure inside the heat transfer pipe even if the heat transfer pipe is made flat, and a heat transfer pipe in which close contact with the plate-like fin is favorable, assembling performance is good and heat transfer performance is excellent can be obtained. Also, by using the flat-shaped heat transfer pipe with excellent heat transfer performance with reduced size and diameter, such a heat exchanger can be obtained in which ventilation resistance is reduced and heat exchange capacity is increased.

MODES FOR CARRYING OUT THE INVENTION

Embodiments of the present invention will be described below referring to the attached drawings.

First Embodiment

Figure 1:
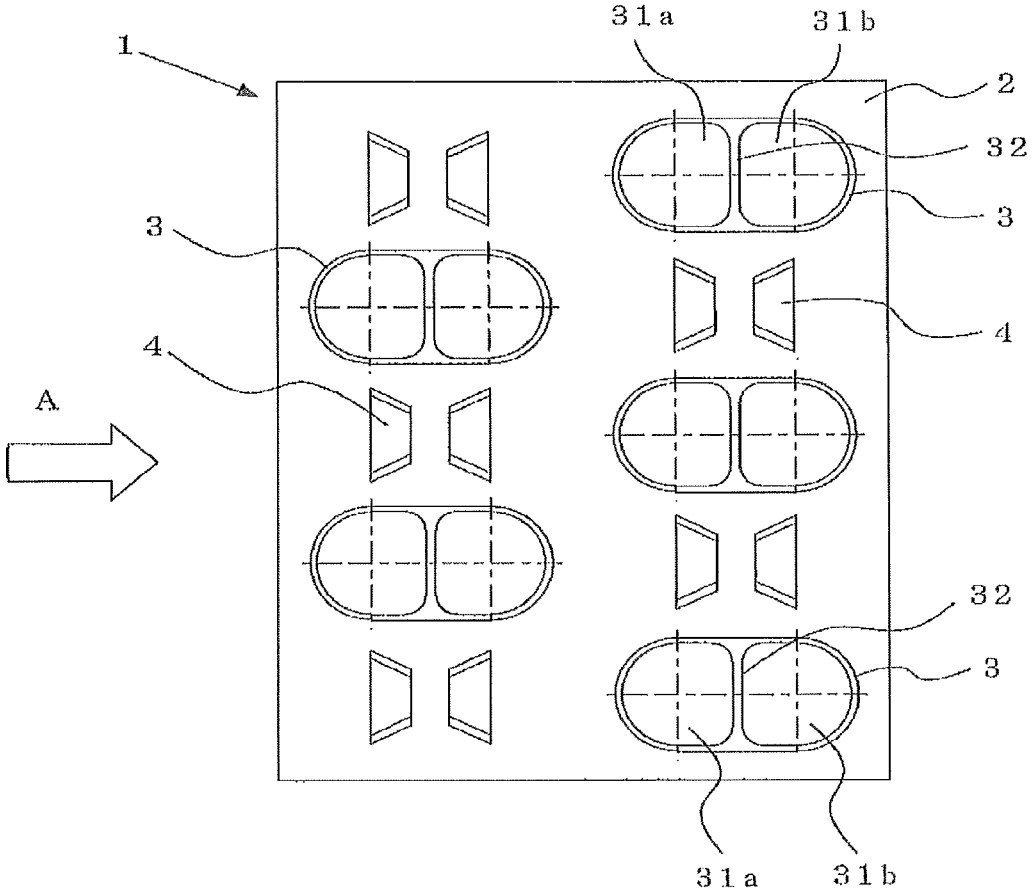
FIG. 1 is a front view illustrating an outline of a heat exchanger according to a first embodiment of the present invention.

FIG. 1 is a front view illustrating an outline of a heat exchanger according to a first embodiment of the present invention. In FIG. 1, reference numeral 1 denotes a heat exchanger constituted by a plurality of plate-like fins 2 arranged in parallel with a predetermined interval and a plurality of flat-shaped heat transfer pipes 3 inserted in a direction orthogonal to the plate-like fins 2 and bonded to the plate-like fins 2 by pipe expansion (also called diameter expansion). The plate-like fins 2 are made of a metal plate such as copper or copper alloy or aluminum or aluminum alloy (similarly in the other embodiments) and provided in parallel with an air flow direction A and with a predetermined interval in a perpendicular direction (depth direction) in the figure. On the plate-like fin 2, the flat-shaped heat transfer pipes 2, which will be described later, are provided in plural stages and in one row or more in a direction (vertical direction in the figure) perpendicular to the air flow direction A. Moreover, a plurality of slits 4 are provided in the plate-like fin 2 by cutting between each stage of the flat-shaped heat transfer pipes 3. The slit 4 is, as shown in Patent Document 2, provided so that a side end portion of the slit 4 opposes the air flow direction A, and by thinning a speed boundary layer and a temperature boundary layer of the air flow at the side end portion, such an advantage is provided that heat transfer is promoted and heat exchange capacity is increased.

Figure 2:
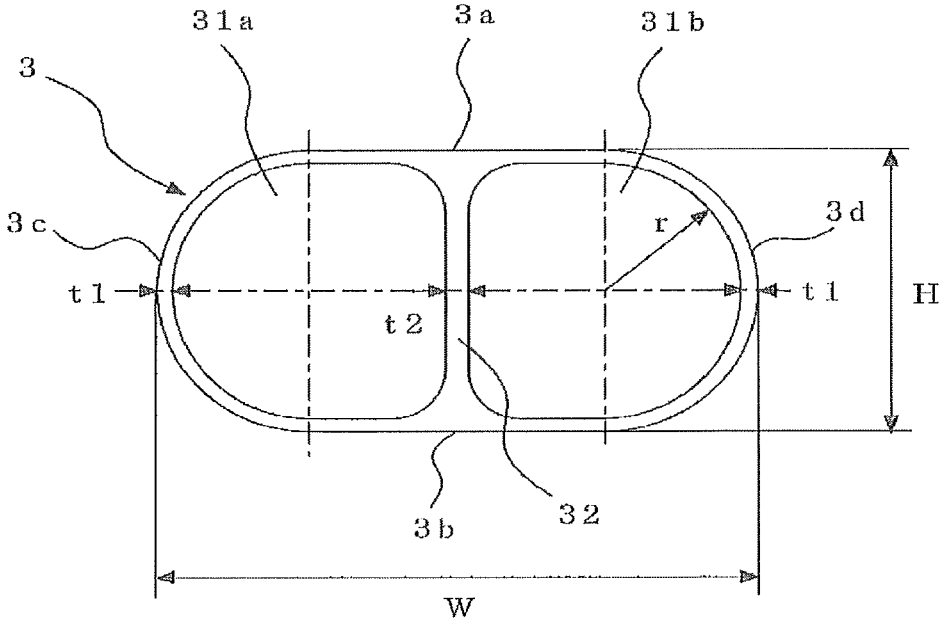
FIG. 2 is a front view of a heat transfer pipe of the first embodiment.

The heat transfer pipe 3 is formed such that, as shown in FIG. 2, the pipe is elongated along the air flow direction A, upper and lower outer faces 3*a*, 3*b* are flat and a section is substantially in an oval shape (or flat elliptic shape). That is, the upper and lower outer faces 3*a* and 3*b* are flat and side faces 3*c*, 3*d* on an upwind side and a downwind side have a flat outside shape forming a semicircle. This flat-shaped heat transfer pipe 3 is made of a metal material such as copper or copper alloy or aluminum or aluminum alloy and the like and formed by an extrusion material (similarly in the other embodiments). Inside the heat transfer pipe 3, first and second refrigerant flow passages 31*a*, 31*b* made of two symmetric substantially D-shaped through holes are provided on both sides in the horizontal direction (hereinafter referred to as width direction) in the figure in parallel with the axial direction having a bulkhead 32 between them. That is, the heat transfer pipe 3 has a flat and substantially D-shaped two-hole structure.

A radius r after diameter expansion (which will be described later) of the first, second refrigerant flow passages 31*a*, 31*b* made of such substantially D-shaped through holes is 1 to 3 mm. That is because if the radius r is less than 1 mm, an increase amount of pressure loss becomes larger than an increase amount of heat transfer rate, which results in lowered heat exchange performance. On the other hand, if the radius r exceeds 3 mm, not only that an inter-pipe refrigerant flow velocity is slowed and the heat exchange performance is lowered but that a height (thickness) H and a width W of the flat-shaped heat transfer pipe 3 are increased and the pressure loss of the air flow is increased. Thus, the radius r after the diameter expansion of the first, second refrigerant flow passages 31*a*, 31*b* is set at 1 to 3 mm (the same applies to the radius r of the refrigerant flow passage in the other embodiments).

Subsequently, an example of a diameter expansion procedure of the first, second refrigerant flow passages 31*a*, 31*b* of the above flat-shaped heat transfer pipe 3 and a mounting procedure to a mounting hole (long hole) 22 provided in the plate-like fin 2 will be described.

Figure 3:
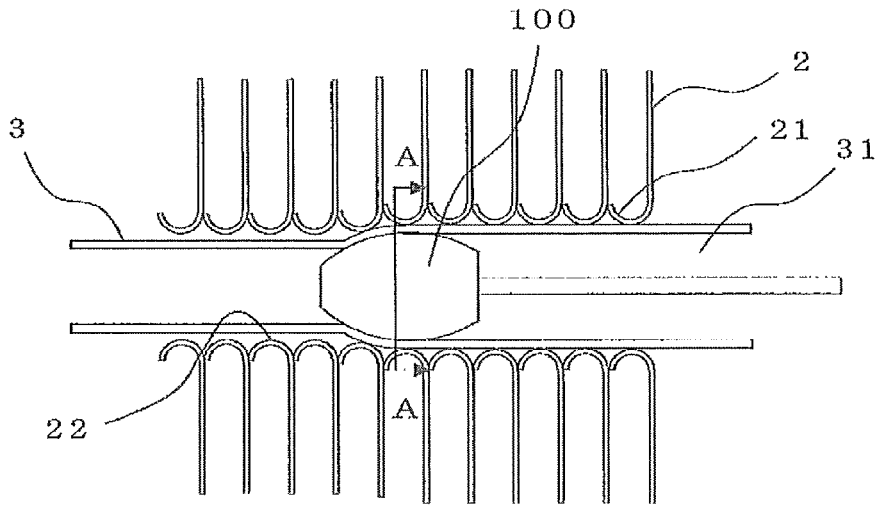
FIG. 3 is an explanatory diagram of pipe-expanding means for the heat transfer pipe in FIG. 2.
Figure 4:
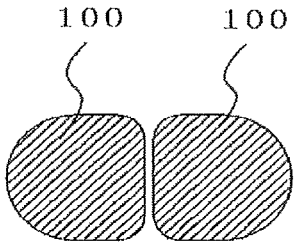
FIG. 4 is A-A sectional view of the pipe-expanding means in FIG. 3.

As shown in FIG. 3, the long-hole mounting hole 22 is provided in a fin collar portion 21 of the pressed plate-like fin 2, and each of the plate-like fins 2 is held by a jig (not shown) or the like with the fin collar portion 21 aligned in the same direction. The above-mentioned flat-shaped heat transfer pipe 3 is inserted into the mounting hole 22 of each of the plate-like fins 2, and then, using a pipe expanding device using a pair of pipe-expanding burette balls 100 made of a metal material such as a super hard alloy or the like and having the same sectional shape (substantially D-shaped, see FIG. 4) as the first, second refrigerant flow passages 31*a*, 31*b*, the pair of pipe expanding burette balls 100 are pushed into the first, second refrigerant flow passages 31*a*, 31*b* by a mechanical method or a fluid pressure. Then, the first, second refrigerant flow passages 31*a*, 31*b* are diameter-expanded at the same time, and the heat transfer pipe 3 is sequentially bonded to each of the plate-like fins 2 and integrally fixed.

In this case, a thickness t2 of the bulkhead 32 of the first, second refrigerant flow passages 31*a*, 31*b* is preferably formed thicker about 1.5 times a thickness t1 of the first, second refrigerant flow passages 31*a*, 31*b*. As a result, pressure capacity of the flat-shaped heat transfer pipe 3 can be increased.

As mentioned above, according to the heat transfer pipe of this embodiment, since the pressure capacity of the flat-shaped heat transfer pipe 3 can be maintained by the bulkhead 32 provided between the first, second flow passages 31*a*, 31*b*, the flat-shaped heat transfer pipe 3 is not deformed by the pressure inside the heat transfer pipe and the close contact with the plate-like fin 2 can be kept favorable. Thus, the heat transfer pipe with excellent heat transfer performance can be obtained. Also, since the flat-shaped heat transfer pipe 3 is bonded to the plate-like fin 2 by pipe expansion, assembling is far easier than brazing. Therefore, a manufacturing cost can be lowered. Moreover, an interval between the plate-like fins 2 can be kept constant by the fin collar portion 21 in the same direction and close contact between the flat-shaped heat transfer pipe 3 and the plate-like fin 2 is favorable, the heat exchanger in which the ventilation resistance is reduced and heat exchange capacity can be increased can be obtained even if the heat transfer pipe is made flat and the size and diameter are reduced.

Second Embodiment

Figure 5:
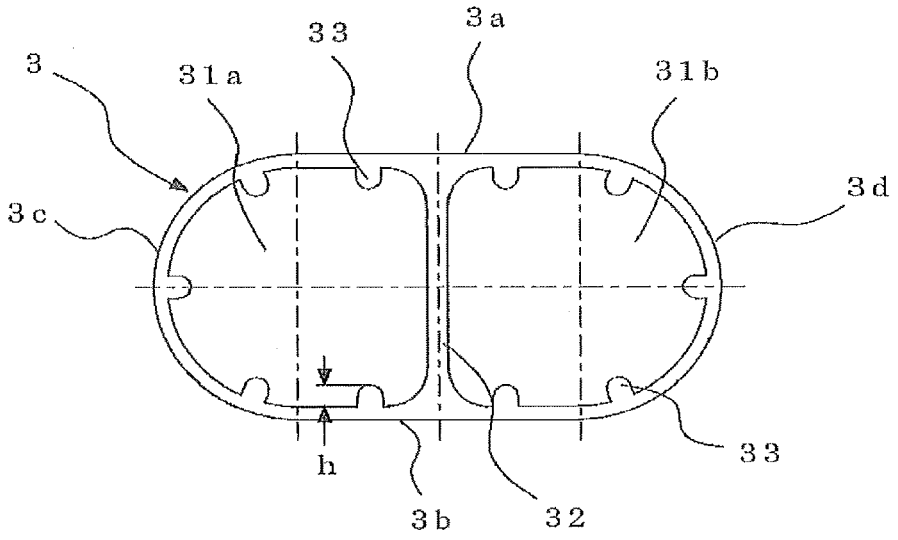
FIG. 5 is a front view of a heat transfer pipe of a second embodiment.

FIG. 5 is a front view illustrating a flat-shaped heat transfer pipe of a second embodiment. The heat transfer pipe 3 of this embodiment has, as in the case of FIG. 2, the first, second refrigerant flow passages 31*a*, 31*b* made of through holes having substantially a D-shaped section provided on both sides in the width direction. On inner wall faces of the first, second refrigerant flow passages 31*a*, 31*b*, respectively, a plurality of protruding strips 33 having a substantially square section (its distal end portion is in a slightly rounded shape) are provided in the axial direction with a constant height and interval.

The above flat-shaped heat transfer pipe 3 is inserted into the mounting hole 22 of the plate-like fin 2 according to the above-mentioned procedure and fixed to the plate-like fin 2 by expanding the diameters of the first, second refrigerant flow passages 31*a*, 31*b* through each protruding strip 33 using the pipe-expanding burette balls 100 having the same sectional shape (substantially D-shape) as above.

Figure 6:
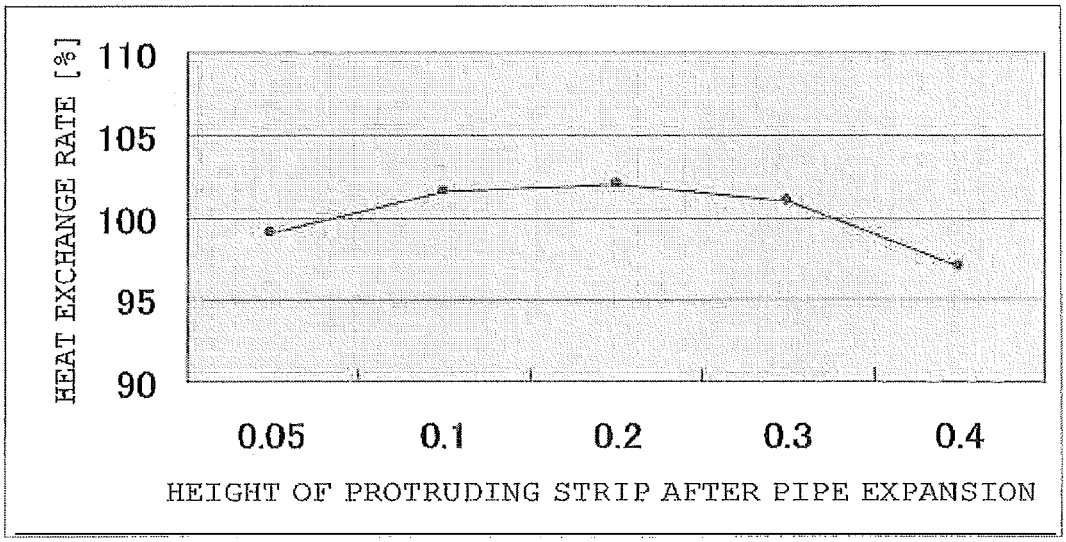
FIG. 6 is a diagram illustrating a relation between a height of a protruding strip and a heat exchange rate after pipe expansion.

As shown in FIG. 6, in the flat-shaped heat transfer pipe 3 of this embodiment, the higher a height h (protruding length) of the protruding strip 33 after pipe expansion is, the higher the heat transfer rate becomes since a contact area is increased. However, if the height h of the protruding strip 33 after the pipe expansion exceeds 0.3 mm, the increase amount of pressure loss becomes larger than the increase amount of the heat transfer rate, and as a result, the heat exchange rate is lowered. On the other hand, if the height h of the protruding strip 33 after the pipe expansion is less than 0.1 mm, the heat transfer rate is not improved. Thus, in the flat-shaped heat transfer pipe 3 of this embodiment, the height h (protruding length) of the protruding strip 33 after the pipe expansion is preferably approximately 0.1 to 0.3 mm. The sectional shape of the protruding strip 33 is not limited to a square, but any appropriate sectional shape such as triangle, trapezoid, semicircle and the like can be employed.

Third Embodiment

Figure 7:
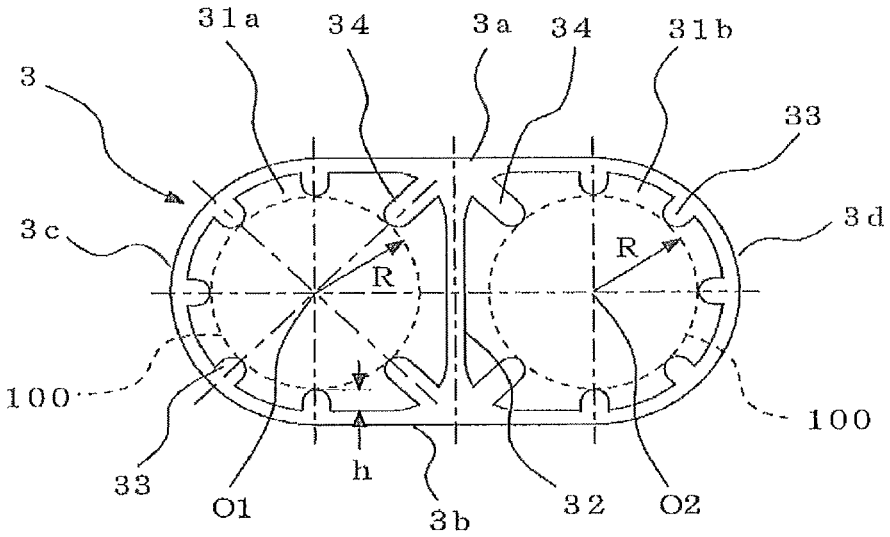
FIG. 7 is a front view of a heat transfer pipe of a third embodiment.
Figure 9:
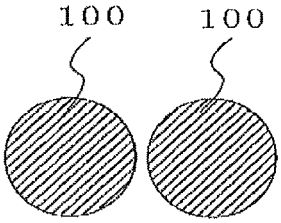
FIG. 9 is B-B sectional view f the pipe-expanding means in FIG. 8.

FIG. 7 is a front view illustrating a flat-shaped heat transfer pipe of a third embodiment. The heat transfer pipe 3 of this embodiment has, similarly to FIG. 2, the first and second refrigerant flow passages 31*a*, 31*b* made of through holes having sections substantially in the D-shape provided on both sides in the width direction. On the inner wall faces of the first, second refrigerant flow passages 31*a*, 31*b*, a plurality of protruding strips 33, 34 having a predetermined height and interval and sections substantially in a square shape (the distal end portions are in a slightly rounded shape) are provided in the axial direction. The protruding strip 34 is provided at corner portions of the bulkhead 32 and further at a required height h so that distal ends of the protruding strips 33, 34 are brought into contact with a circle with a radius R, that is, an outer circumferential face (See FIG. 9) of a circle of the pipe-expanding burette ball 100.

In other words, the first, second refrigerant flow passages 31*a*, 31*b* on which the plurality of protruding strips 33, 34 are provided are constituted so that a distance from predetermined points at the center parts of the refrigerant flow passages in the section (O1, O2 in FIG. 7) to each of the distal end portions of the plurality of the protruding strips 33, 34 becomes substantially equal. The points O1, O2 are points matching the centers of the pipe-expanding burette balls 100 when the pipe is expanded.

Figure 8:
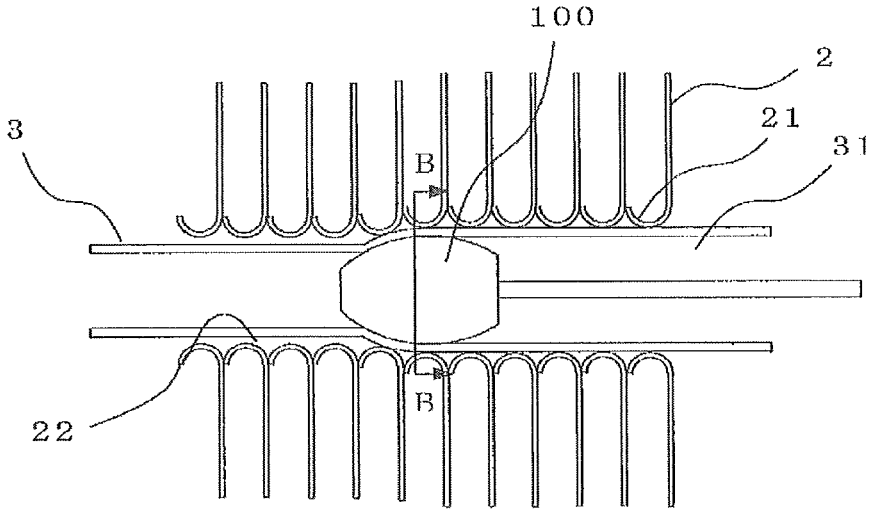
FIG. 8 is an explanatory diagram of pipe-expanding means for the heat transfer pipe in FIG. 7.

This flat-shaped heat transfer pipe 3 is inserted into the mounting hole 22 of the plate-like fin 2 as shown in FIG. 8 according to the above-mentioned procedure and fixed to the plate-like fin 2 by expanding the diameters of the first, second refrigerant flow passages 31*a*, 31*b* through each protruding strip 33, 34 using pipe-expanding burette balls 41 having a circular section. In this case, the height h (protruding length) of the protruding strip 33 is preferably approximately 0.1 to 0.3 mm. By using the pipe-expanding burette ball 100 having the circular outer circumferential face, the pipe-expanding burette ball can be easily positioned. The sectional shape of the protruding strips 33, 34 is not limited to a square, but any appropriate sectional shape such as triangle, trapezoid, semicircle and the like can be employed.

Fourth Embodiment

Figure 10:
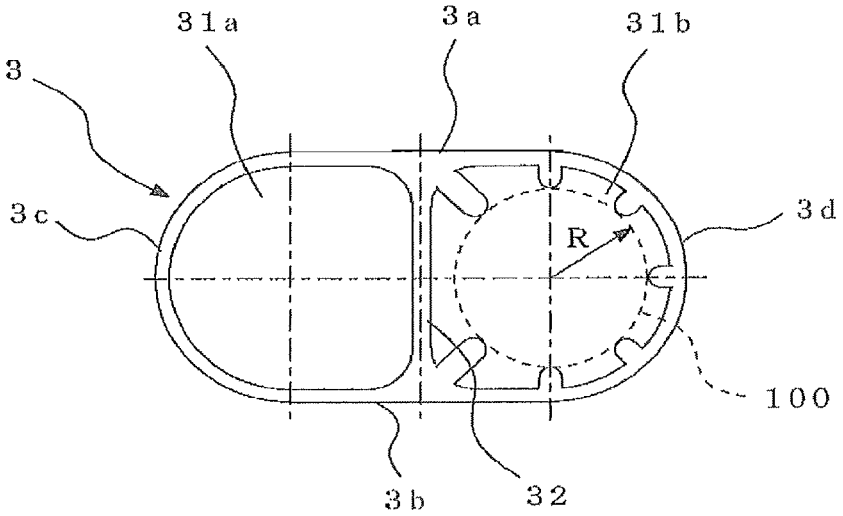
FIG. 10 is a front view of a heat transfer pipe of a fourth embodiment.

FIG. 10 is a front view illustrating a flat-shaped heat transfer pipe of a fourth embodiment. The heat transfer pipe 3 of this embodiment has the first refrigerant flow passage 31*a* in the same shape as that of the first embodiment and the second refrigerant flow passage 31*b* in the same shape as that of the third embodiment. It is needless to say that the combination may be opposite.

This flat-shaped heat transfer 3 is inserted into the mounting hole 21 of the plate-like fin 2 according to the above-mentioned procedure and fixed to the plate-like fin 2 by expanding the diameter of the first refrigerant flow passage 31*a* using the pipe-expanding burette ball 41 having a substantially D-shaped section and by expanding the diameter of the second refrigerant flow passage 31*b* using the pipe-expanding burette ball 41 having a circular section. In this case, the height h (protruding length) of the protruding strip 33 is preferably approximately 0.1 to 0.3 mm. The sectional shape of the protruding strip 33 is not limited to a square, but any appropriate sectional shape such as triangle, trapezoid, semicircle and the like can be employed.

According to this embodiment, the first embodiment and the third embodiment are applied in combination to the first, second refrigerant flow passages 31*a*, 31*b*, and the effect substantially similar to these embodiments can be obtained. That is, the flat-shaped heat transfer pipe 3 is not deformed by the pressure inside the heat transfer pipe, and close contact with the plate-like fin 2 can be maintained favorable. Thus, the heat transfer pipe having excellent heat transfer performance can be obtained. Also, since the flat-shaped heat transfer pipe 3 is bonded to the plate-like fin 2 by pipe expansion, assembling is far easier than brazing. Therefore, a manufacturing cost can be reduced. Moreover, since each of the plate-like fins 2 can be maintained with a constant interval by the fin collar portion 21 in the same direction and close contact between the flat-shaped heat transfer pipe 3 and the plate-like fin 2 is favorable, even if the heat transfer pipe is made flat or reduced in size and diameter, a heat exchanger in which ventilation resistance is reduced and heat exchange capacity can be increased can be obtained.

Also, if the plurality of protruding strips 33, 34 are provided on the inner wall face of the refrigerant flow passage 31*b*, either of the refrigerant flow passages, a contact area with the refrigerant is increased, and since the height h of the protruding strip 33 is set at approximately 0.1 to 0.3 mm, a pressure inside the flow passage is not increased but the heat transfer performance can be further improved.

Fifth Embodiment

Figure 11:
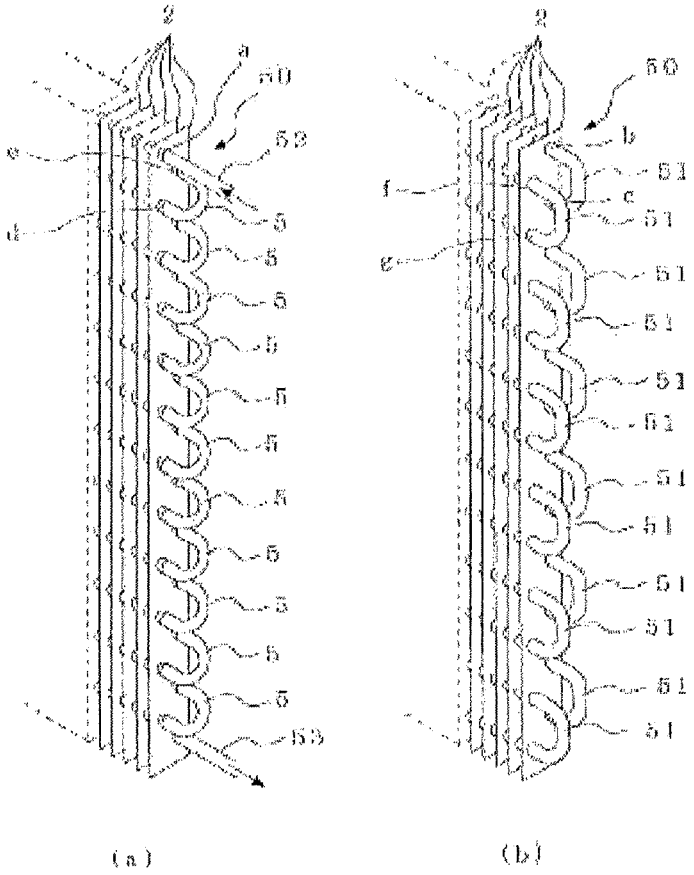
FIG. 11 are explanatory views of a prior-art fin-tube heat exchanger.
Figure 12:
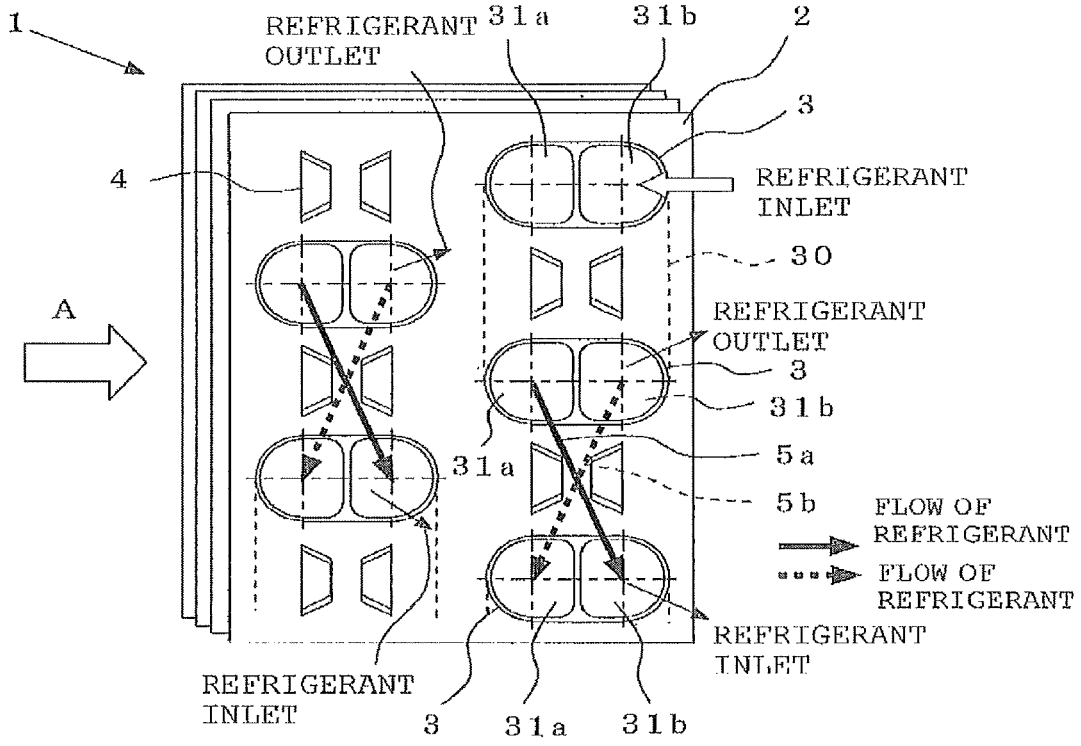
FIG. 12 is a front view illustrating an outline of a heat exchanger according to a fifth embodiment.

FIG. 11 are explanatory diagrams illustrating a prior-art fin-tube heat exchanger, in which FIG. 11A shows a front face side, and FIG. 11B shows a back face side of a heat transfer pipe connected state. FIG. 12 is a front view of a heat exchanger according to a fifth embodiment.

First, FIG. 11 will be described. The heat transfer pipe is given bending work in a hairpin state with a predetermined bending pitch at its intermediate portion so as to manufacture a plurality of hairpin pipes 51, and then, the plurality of hairpin pipes 51 are inserted from the back face side into plate-like fins 2 arranged in parallel with each other with a predetermined interval. Then, the heat transfer pipe is expanded by a mechanical method or a liquid-pressure pipe expanding method and the plate-like fin 2 and the heat transfer pipe are bonded together. Subsequently, using a plurality of return bend pipes 5 given bending work with predetermined length and pitch, the return bend pipe 5 having a braze ring on its outer face is attached to a pipe end of the adjacent hairpin pipe 51 after pipe expansion, and the both pipes are heated and brazed by a burner so as to manufacture a heat exchanger 50.

Subsequently a flow of refrigerant of the prior-art fin-tube heat exchanger 50 will be described. The refrigerant enters from an inlet pipe 52, flows out from "a" on the front face side to "b" on the back face side, flows in from "c" through the hairpin pipe 51 and flows out to "d" on the front face side, passes through the return bend pipe 5 on the front face side, and flows into the hairpin pipe 51 in the subsequent stage from "e". As mentioned above, the refrigerant fluidizes downward through the heat transfer pipe as a→b→c→d→e→f→g→ . . . , and the refrigerant finally flows out of a flow-out pipe 53 on the lower stage. During that period, heat exchange is performed with air passing between the plate-like fins 2.

On the other hand, with regard to the heat exchanger 1 of this embodiment, as shown in FIG. 12, explaining arrangement of the heat transfer pipe 3 on the right side in the figure (a part of the intermediate part of the arrangement of the right and left heat transfer pipes is assumed to be shown), for example, a plurality of hairpin pipes 30 are manufactured by applying bending work to the transfer pipe 3 at the intermediate part with predetermined bending pitch and then, the plurality of hairpin pipes 30 are inserted into the plate-like fins 2 arranged in parallel with each other with a predetermined interval from the back face side. Then, the heat transfer pipe 3 is expanded by the mechanical method or liquid pressure pipe expansion method as mentioned above, and the plate-like fin and the heat transfer pipe 3 are bonded together. Moreover, in the hairpin pipe 30, pipe ends of the heat transfer pipe 3 on the second stage and the heat transfer pipe 3 on the third stage are connected by two return bend pipes 5*a*, 5*b* made of a metal material of aluminum or aluminum alloy and the like in a cross state. That is, the first refrigerant flow passage 31*a* on the upwind side of the heat transfer pipe 3 on the second stage and the second refrigerant flow passage 31*b* on the downwind side of the heat transfer pipe 3 on the third stage are connected by the return bend pipe 5*a*, and the second refrigerant flow passage 31*b* on the downwind side on the heat transfer pipes 3 on the second stage and the first refrigerant flow passage 31*a* on the upwind side of the heat transfer pipe 3 on the third stage are connected by the return bend pipe 5*b*. The heat transfer pipe 3 on the third stage and on the fourth stage, not shown, are constituted as hairpin pipes 30, and the heat transfer pipes on the fourth stage and the fifth stage, not shown, are connected by the return bend pipes similarly to the above in a cross state. The heat exchanger 1 of this embodiment has a plurality of refrigerant circuits constituted in the column direction as above.

In the heat exchanger 1 of this embodiment, the refrigerant separately flows into the first, second refrigerant flow passages 31*a*, 31*b* of the heat transfer pipe 3 on the first stage, respectively, at the same time. The refrigerant flowing into the first refrigerant flow passage 31*a* of the heat transfer pipe 3 on the first stage flows out of the first refrigerant flow passage 31*a* of the heat transfer pipe 3 on the second stage through the hairpin pipe 30 and flows into the second refrigerant flow passage 31*b* of the heat transfer pipe 3 on the third stage further through the return bend pipe 5*a*. On the other hand, the refrigerant flowing into the second refrigerant flow passage 31*b* of the heat transfer pipe 3 on the first stage flows out of the second refrigerant flow passage 31*b* of the heat transfer pipe 3 on the second stage through the hairpin pipe 30 and flows into the first refrigerant flow passage 31*a* of the heat transfer pipe 3 on the third stage further through the return bend pipe 5*b*.

Therefore, according to the heat exchanger 1 of this embodiment, since the refrigerant fluidizes alternately in a cross state by the return bend pipes 5*a*, 5*b*, the heat exchange capacity on the upwind side and the heat exchange capacity on the downwind side can be well-balanced, and a heat exchanger with high efficiency can be obtained.

Sixth Embodiment

Figure 13:
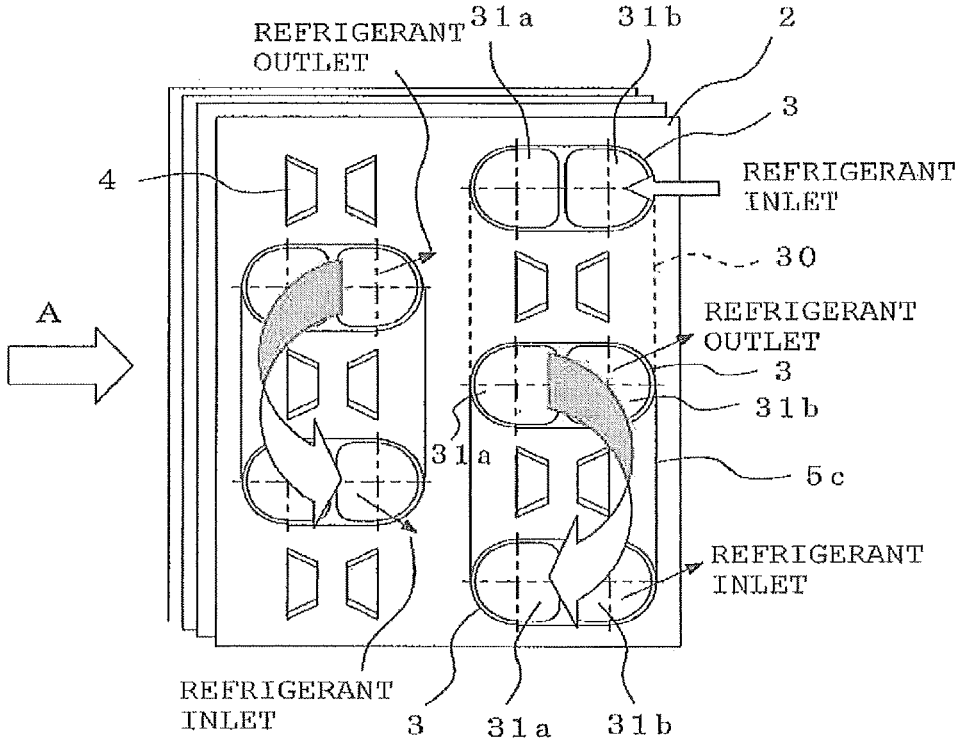
FIG. 13 is a front view illustrating an outline of a heat exchanger according to a sixth embodiment.

FIG. 13 is a front view illustrating an outline of a heat exchanger according to a sixth embodiment. This embodiment is different from the fifth embodiment only in that the pipe ends of the heat transfer pipes 3 on the second stage and the third stage in the adjacent hairpin pipes 30 are connected by a return bend pipe 5*c* having a single flow passage so that the refrigerants are mixed.

As a result, a mass ratio of a gas phase and a liquid phase becomes the same at outlet sides of the plurality of refrigerant circuits of the heat transfer pipe and it enters the refrigerant inlet portion of the heat transfer pipe on the subsequent stage, the heat exchange capacity on the upwind side and the heat exchange capacity on the downwind side can be well-balanced, and a heat exchanger with high efficiency can be obtained.

Also, the heat exchanger 1 constituted by using the flat-shaped heat transfer pipe 3 of each of the above embodiments can be used, in a refrigerating cycle circuit constituted by sequentially connecting compressor, condenser, throttle device, evaporator by piping, as the condenser or evaporator using a HC single refrigerant of a mixed refrigerant containing HC or a refrigerant of any of R32, R410A, R407C, carbon dioxide and the like as an operating fluid.

REFERENCE NUMERALS

1 heat exchanger
2 plate-like fin
3 heat transfer pipe
4 slit
5, 5*a*, 5*b*, 5*c* return bend pipe
21 fin collar portion
22 mounting hole
30 hairpin pipe
31*a* first refrigerant flow passage
31*b* second refrigerant flow passage
32 bulkhead
33, 34 protruding strip
100 pipe-expanding burette ball

The invention claimed is:

1. A heat exchanger provided with a plurality of plate-like fins arranged in parallel with a predetermined interval and a plurality of flat-shaped heat transfer pipes inserted in a direction orthogonal to said plate-like fins and through which a refrigerant flows, wherein said heat transfer pipes have an outside shape with a flat outer face arranged along an air flow direction and a section substantially in an oval shape and first and second refrigerant flow passages made of two symmetric and substantially D-shaped through holes having a bulkhead between the two passages inside, which are press bonded to said plate-like fins by expanding diameters of said first and second refrigerant flow passages by a pipe-expanding burette ball, said first and second refrigerant flow passages have a plurality of protruding strips extending in an axial direction on an inner wall face other than said bulkhead, said plurality of protruding strips includes a protruding strip provided at corner portions of the bulkhead with a greater height than other protruding strips in said plurality of protruding strips, and distances from a center of said first and second refrigerant flow passages in the substantially oval-shaped section to each of the distal end portions of the plurality of the protruding strips are substantially equal, the center of said first and second refrigerant flow passages match a center of the pipe-expanding burette balls being inserted into said first and second refrigerant flow passages.

2. The heat exchanger according to claim 1, wherein a height of at least one of the other protruding strips of the plurality of protruding strips after pipe expansion is approximately 0.1 to 0.3 mm.

3. A method of forming a heat exchanger, comprising:

arranging a plurality of plate-like fins in parallel with a predetermined interval;

inserting a plurality of flat-shaped heat transfer pipes through said plurality of plate-like fins in a direction orthogonal to said plurality of plate-like fins, said flat-shaped heat transfer pipes having an outside shape with a flat outer face arranged along an air flow direction and a section substantially in an oval shape, and first and second refrigerant flow passages made of two symmetric and substantially D-shaped through holes having a bulkhead between the first and second refrigerant flow passages, said first and second refrigerant passages having a flow passage with a plurality of protruding strips extending in an axial direction on an inner wall face, wherein said plurality of protruding strips includes a protruding strip provided at corner portions of the bulkhead; and inserting each of a pair of pipe-expanding burette balls into respective ones of said first and second refrigerant passages of said plurality of flat-shaped heat transfer pipes at the same time, said pipe-expanding burette balls being driven along a length of each of said plurality of flat-shaped heat transfer pipes with an outer circumferential face of said pipe-expanding burette balls contacting distal ends of said plurality of protruding strips, to expand a diameter of each of said plurality of flat-shaped heat transfer pipes into contact with said plurality of plate-like fins and press bond said plurality of flat-shaped heat transfer pipes to said plurality of plate-like fins.

4. The method of forming the heat exchanger according to claim 3, wherein a height of at least one of the plurality of protruding strips is approximately 0.1 to 0.3 mm after the diameter of each of said plurality of flat-shaped heat transfer pipes is expanded using said pipe-expanding burette ball.

* * * * *